US006986328B2

(12) United States Patent
Huettlin

(10) Patent No.: US 6,986,328 B2
(45) Date of Patent: Jan. 17, 2006

(54) ROTARY PISTON MACHINE

(76) Inventor: Herbert Huettlin, Ruemminger Strasse 15, 79539 Loerrach (DE)

( * ) Notice: Subject to any disclaimer, the term of this patent is extended or adjusted under 35 U.S.C. 154(b) by 0 days.

(21) Appl. No.: 10/968,647

(22) Filed: Oct. 19, 2004

(65) Prior Publication Data

US 2005/0066917 A1 Mar. 31, 2005

Related U.S. Application Data

(63) Continuation of application No. PCT/EP03/04067, filed on Apr. 17, 2003.

(30) Foreign Application Priority Data

Apr. 19, 2002 (EP) ..... 02008814

(51) Int. Cl.
*F02B 53/00* (2006.01)
*F02B 57/00* (2006.01)

(52) U.S. Cl. ..... 123/45 R; 123/45 A; 123/43 AA

(58) Field of Classification Search ..... 123/45 R, 123/45 A, 43 A, 43 AA, 51 B, 63
See application file for complete search history.

(56) References Cited

U.S. PATENT DOCUMENTS 1,255,664 A * 2/1918 Syger ..... 123/43 A
1,613,136 A * 1/1927 Schieffelin ..... 123/45 A
1,736,822 A * 11/1929 Dreisbach ..... 123/45 A
2,472,647 A * 6/1949 Covins ..... 123/62
4,115,037 A * 9/1978 Butler ..... 123/51 B
4,543,919 A * 10/1985 Carson ..... 123/53.4
4,553,506 A 11/1985 Bekiaroglou ..... 123/45 R
5,351,657 A 10/1994 Buck ..... 123/43 C
5,441,018 A 8/1995 Almassi ..... 123/45 A
5,517,952 A * 5/1996 Wielenga ..... 123/45 R
5,623,894 A * 4/1997 Clarke ..... 123/50 R
6,009,847 A 1/2000 Huttlin ..... 123/241
6,662,775 B2 * 12/2003 Hauser ..... 123/43 AA

FOREIGN PATENT DOCUMENTS

DE 100 01 962 A1 7/2001
FR 2.079.555 10/1971
FR 2.546.232 5/1983
JP 62082236 A * 4/1987
WO WO 98/13583 4/1998

* cited by examiner

*Primary Examiner*—Thai-Ba Trieu
(74) *Attorney, Agent, or Firm*—St. Onge Steward Johnston & Reens LLC

(57) ABSTRACT

A rotary piston machine includes a housing provided with a cylindrical inner wall and at least one piston disposed inside the housing and rotating around a longitudinal central axis of the housing while moving back and forth in a linear manner, under the control of a control mechanism, to periodically enlarge and reduce the size of at least one chamber associated with the piston. The at least one piston moves linearly parallel to the longitudinal central axis of the housing.

36 Claims, 10 Drawing Sheets

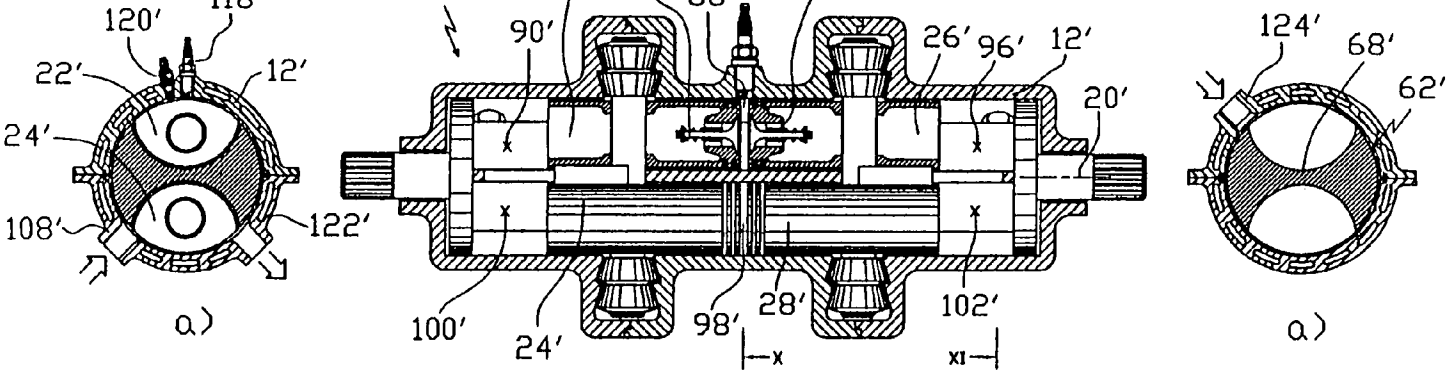
Fig. 10
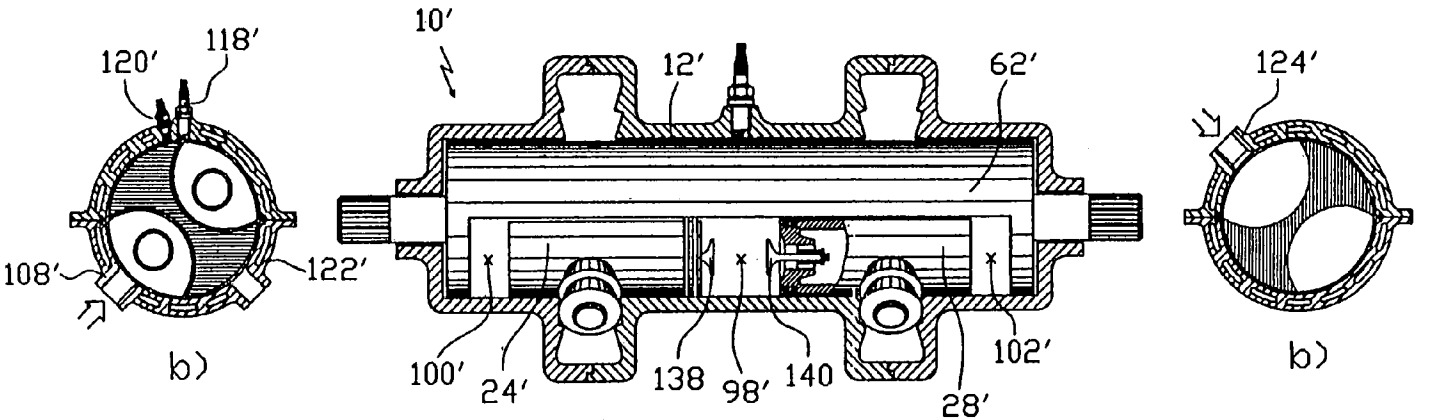
Fig. 9
Fig. 11

ROTARY PISTON MACHINE

CROSS REFERENCE TO RELATED APPLICATIONS

The present application is a continuation of pending international patent application PCT/EP03/04067 filed on Apr. 17, 2003 which designates the United States and which claims priority of European patent application 02008814.2 filed on Apr. 19, 2002.

BACKGROUND OF THE INVENTION

The invention relates to a rotary piston machine, comprising a housing which has a cylindrical housing inner wall, and at least one piston which is arranged in the housing and which can rotate about a longitudinal mid-axis of the housing and at the same time executes, by means of a control mechanism, a to-and-fro linear movement which serves for periodically enlarging and reducing at least one chamber assigned to the piston.

A rotary piston machine of this kind is known from DE 100 01 962 A1.

Such a rotary piston machine is used preferably as an internal combustion engine.

Rotary piston machines belong, in general, to a type of machine in which one or more pistons rotate in a housing, a further type of movement normally being superimposed on the rotational movement of the piston or pistons, in order periodically to enlarge and reduce in volume the one or more chambers which are assigned to the piston or pistons and which conventionally form the working chambers for a Carnot cycle.

In the rotary piston machine known from DE 100 01 962 A1, a plurality of pistons are arranged so as to be distributed circumferentially about the housing mid-axis of the housing. The pistons are mounted radially moveably in the housing, the control mechanism deriving the radially directed to-and-fro stroke movement of the pistons from the rotational movement of the pistons.

When the known rotary piston machine is used as an internal combustion engine, the individual working strokes of admission, compression, expansion and expulsion are therefore implemented by means of the radially directed to-and-fro stroke movement of the individual pistons.

The control mechanism of the known rotary piston machine has a fixed cam piece arranged approximately in the centre of the housing, the pistons each having at least one running member on their side facing the housing mid-axis, the pistons being guided along the control cam by means of the said running members. Furthermore, the control mechanism is designed in such a way that in each case adjacent pistons of the radially moveable pistons execute an oppositely directed stroke movement. The pistons of the known rotary piston machine have in each case a toothing on their end faces leading and trailing in the direction of rotation of the pistons, and between the end faces of adjacent pistons in each case is arranged a co-rotating shaft which is provided with a toothing and which is in meshing engagement with the toothings of the two adjacent end faces of the pistons.

One disadvantage of this known rotary piston machine may be seen in that the radially directed linear movement of the pistons takes place alternately in the direction of and counter to the action of the centrifugal force and the action of the centrifugal force. In this case, because of the radially directed stroke movement of the individual pistons, the mass distribution with respect to the longitudinal mid-axis of the housing and consequently also the moment of inertia of the pistons change constantly. Moreover, because of the centrifugal forces and the mechanical coupling in each case of adjacent pistons moving radially in opposition, the cam piece which is located in the centre of the housing and is fixed relative to the housing and which serves for guiding the pistons is subjected to load exerted by forces.

Another type of rotary piston machine is known from WO 98/13583, in which the individual pistons rotating in the housing are designed as pivoting pistons which, during their rotational movement, additionally execute rocker-like to-and-fro pivoting movements in the housing. The control mechanism for controlling the rocker-like to-and-fro pivoting movements of the individual pistons corresponds virtually identically to the control mechanism of the abovementioned known rotary piston machine with pistons radially moveable linearly.

In this pivoting piston machine, too, a disadvantage may be seen in the mass distribution which is not optimum with respect to the longitudinal mid-axis of the housing or in the incomplete cancellation of the resultant centrifugal forces of the individual pistons.

The invention is based on the object to provide a new kind of a rotary piston machine in which the periodic alteration of the volume of the at least one chamber is achieved in another fashion.

SUMMARY OF THE INVENTION

According to an aspect of the invention, a rotary piston machine is provided, comprising a housing having a cylindrical housing inner wall and a longitudinal mid-axis; at least one piston arranged in said housing which can rotate about said longitudinal mid-axis and at the same time executes, by means of a control mechanism, a to-and fro linear movement parallel to said longitudinal mid-axis; at least one chamber in said housing assigned to said at least one piston which periodically enlarges and reduces due to said to-and-fro linear movement of said at least one piston.

In the rotary piston machine according to the invention, the at least one piston, during rotation about the longitudinal mid-axis of the housing, executes a linear movement directed parallel to the longitudinal mid-axis of the housing. The at least one piston thus does not possess a radially directed movement component. This affords the advantage that the distance of the mass centre of gravity of at least one piston from the longitudinal mid-axis of the housing, which forms the axis of rotation of the piston, is invariable. The advantage of improved quiet running of the rotary piston machine is thereby achieved.

A further advantage, as compared with the known piston machine, is that the rotary piston machine according to the invention may be designed with a radially small build, since the at least one piston does not have to execute any radial movement or a movement with a radial movement component. The rotary piston machine according to the invention is suitable, in particular, as an internal combustion engine, in which case the at least one chamber then serves as a working chamber for a Carnot cycle, in which the working strokes of admission, compression, expansion and expulsion take place.

It is to be understood that the rotary piston machine according to the invention preferably comprises more than one piston, wherein then the plurality of pistons all execute, during rotation in the housing, linear movements which are directed parallel to the longitudinal mid-axis of the housing, as is described hereafter with reference to preferred embodiments.

In a preferred embodiment, the piston is arranged eccentrically with respect to the longitudinal mid-axis of the housing, and the housing has arranged in it at least one further piston which rotates about the longitudinal mid-axis and which is arranged, with respect to the longitudinal mid-axis of the housing, on the side facing away from the first piston.

In this embodiment, the rotary piston machine according to the invention can be implemented as an at least two-cylinder internal combustion engine, in which case, by the at least two pistons, which do not necessarily have to lie at the same height axially, being arranged opposite one another with respect to the longitudinal mid-axis, and with the pistons being designed identically, a mass distribution which is axially symmetrical with respect to the longitudinal mid-axis can be achieved. The centrifugal forces acting on the two pistons advantageously cancel one another during rotation in the housing. The two pistons may in this case be arranged in such a way that the linear movements take place in the opposite direction to one another by means of the control mechanism, or the linear movement of the two pistons may be in the same direction.

In this context, it is further preferred, if the further piston is arranged opposite the first piston at the same height axially.

In this embodiment, too, the advantage is achieved that the centrifugal forces of the two pistons can cancel one another due to their axially symmetrical arrangement with respect to the longitudinal mid-axis. As in the abovementioned embodiment, in this arrangement, two chambers may be formed, which are arranged so as to be offset at 180° to one another about the longitudinal mid-axis, so that two full working cycles are completed over one full revolution of the piston arrangement.

Within the scope of the previously mentioned embodiment, it is preferred, furthermore, if the further piston is connected fixedly to the first piston.

In this case, it is advantageous that the two pistons located opposite one another are supported relative to one another against the centrifugal forces acting on them during rotation, and surface friction of the pistons against the housing is thereby eliminated.

In a further preferred embodiment the at least one piston is arranged centrically about the longitudinal mid-axis and rotates about a piston mid-axis coinciding with the longitudinal mid-axis in the housing.

With this embodiment, the advantage of a structurally particularly simple embodiment of the rotary piston machine according to the invention is achieved. In this embodiment, centrifugal forces are eliminated without an additional piston arranged on axially equal height.

In a further preferred embodiment, the housing has arranged in it at least one further piston which rotates about the longitudinal mid-axis and which is arranged in the rectilinear prolongation of the first piston.

The advantage of this measure is that a plurality of chambers can be implemented in the longitudinal direction of the housing, so that a multi-cylinder rotary piston machine can likewise be implemented in this way.

In this connection, it is preferred if the at least one chamber is formed by the space between mutually confronting end faces of the first piston and of the further piston.

In this case, it is advantageous that, with the two pistons moving in opposite directions, the individual strokes of the two pistons add up to form a total stroke, as a result of which, when the rotary piston machine according to the invention is used in the internal combustion engine, the fuel/air mixture can be compressed with a higher pressure in the common chamber between the two pistons.

In a further preferred embodiment, the linear movement of the first piston is directed opposite to the linear movement of the second piston, and the space between the mutually confronting end faces of the first piston and of the further piston forms a common chamber.

The advantage of this measure is that the rotary piston machine according to the invention is thereby compensated in mass also with regard to the linear movement of the at least two pistons, as a result of which vibrations of the rotary piston machine in the longitudinal direction are eliminated.

In a combination of the abovementioned embodiments, it is particularly preferred if the housing has arranged in it at least four pistons, of which in each case two are arranged opposite one another at the same height axially with respect to the longitudinal mid-axis of the housing and in each case two are arranged in the rectilinear prolongation of one another.

In this embodiment of the rotary piston machine according to the invention with four pistons, the two pistons arranged opposite one another at the same height axially with respect to the longitudinal mid-axis of the housing form in each case a preferable rigid double piston, the two double pistons then being arranged in the axially rectilinear prolongation of one another and rotate jointly in the housing about the longitudinal mid-axis and execute linear movements directed opposite to one another. In this embodiment, one double piston and the other double piston are preferably assigned in each case an own control mechanism for controlling the to-and-fro linear movement during rotation in the housing.

In a preferred embodiment, the control mechanism comprises at least one guide member arranged on the at least one first piston and at least one control cam curve which is formed in the housing inner wall and along which the guide member runs.

Such a control mechanism has the advantage, as compared with the control mechanism of the known rotary piston machine, that it is less susceptible to wear, because, in contrast to the control mechanism of the known rotary piston machine which comprises a cam piece arranged centrally in the housing and running members provided on the pistons, it is not subject to the action of the centrifugal forces caused by the rotational movement of the pistons. Provided as a guide member, on the at least one first piston, is preferably an axle which projects radially from the side of the latter facing the housing inner wall and on which one or two running rollers are arranged, while the control cam is preferably designed as a guide groove which is formed in the housing inner wall and into which the running rollers engage and roll in the housing during the rotation of the piston.

In connection with one or more of the above-mentioned embodiments, according to which a further piston is arranged opposite the first piston with respect to the longitudinal mid-axis at the same height axially and the two pistons are firmly connected to one another, it is further preferred if a guide member is arranged in each case on the first piston and the further piston, the two guide members running along the same control cam curve.

In this case, it is advantageous that the mass centre of gravity of the two pistons located opposite one another at the same height lies on the longitudinal mid-axis, that is to say the axis of rotation, which would not be the case if there were a running member on only one of the two pistons. The latter embodiment may, however, likewise be taken into consideration, in which case the piston which has no guide members may have a corresponding additional mass for mass compensation with respect to the longitudinal mid-axis.

In a further preferred embodiment, one side of the at least one piston, the said side facing the housing inner wall, is designed in the form of a part-circle in cross section.

The advantage of this measure is that that side of the at least one piston which faces the housing inner wall is adapted to the circular inner contour of the housing inner wall, with a result that the piston can be sealed off in an advantageously simple way by means of seals in the form of segments of a circle. Preferably, that side of the at least one piston which faces the housing inner wall extends over approximately 90°.

It is further preferred, if the at least one piston is guided in its linear movement by a rotor which rotates about the longitudinal mid-axis jointly with the piston and which is axially immovable.

The provision of a rotor has the advantage that the rotational movement of the at least one piston in the housing can be picked up by the rotor via an output shaft connected to the rotor, for example when the rotary piston machine according to the invention is used as an internal combustion engine in a motor vehicle. In this way, the rotational movement can be picked up centrally on the longitudinal mid-axis of the housing of the rotary piston machine, without complicated transmission shafts or countershafts being necessary. In this way, the rotary piston machine according to the invention can simulate a conventional reciprocating-piston engine, as compared with which, however, the rotary piston machine according to the invention has the considerable advantage that, by virtue of the rotational movement of the at least one piston, the rotational energy can be derived via the rotor, which is axially immoveable.

In preferred embodiments, the rotor can be configured as a sleeve or as an axle.

In connection with one of the previously mentioned embodiments, according to which at least two pistons are arranged opposite with respect to the longitudinal mid-axis, whether on axially equal height or on axially different position, it is further preferred, if the rotor has a middle portion which lies on the longitudinal mid-axis of the housing and which separates the chamber assigned to the first piston from the chamber assigned to the further piston.

In this way, without additional complicated structural measures, the rotor also assumes the function of separating the at least two chambers which, for example with regard to the use of the rotary piston machine as an internal combustion engine, form working chambers for a Carnot cycle.

In a further preferred embodiment, each of the two end faces of the at least one piston is assigned a chamber, the said chambers being reduced and enlarged in opposite directions, in which case one chamber serves as a working chamber for a Carnot cycle and the other chamber as a boost-pressure chamber for generating a boost pressure, in order to supply the working chamber with a boost pressure.

In this case, it is advantageous that, with the rotary piston machine according to the invention being used as an internal combustion engine, self-charging of the working chambers is achieved without external devices, such as a compressor or a turbocharger, and without enlarging the construction space of the rotary piston machine. While the working chamber is being reduced, for example, in volume, the boost-pressure chamber, into which fresh air can be sucked, is enlarged correspondingly. During the expansion of the working chamber after the ignition of the fuel/air mixture, the fresh air previously sucked into the boost-pressure chamber is correspondingly compressed and, after the expulsion of the burnt fuel/air mixture out of the working chamber, can then be forced under pressure into the latter, with the result that the fuel/air mixture can be compressed with higher pressure in the next cycle. Particularly with the preferred embodiment of the rotary piston machine with four pistons, a particularly effective self-charging effect can be achieved. In this embodiment, the rotary piston machine according to the invention is suitable, in particular, as an internal combustion engine for operation with diesel or even biodiesel fuels.

In a further preferred embodiment, the middle portion of the rotor is absent or configured such on the sides of the chambers serving as boost-pressure chambers that in each case two of the chambers serving as boost-pressure chambers communicate with one another.

In this case, the advantage is that the chambers serving as boost-pressure chambers form together a boost-pressure chamber having a total volume which is larger, preferably four times as large as the volume of the at least one working chamber, whereby the air precompressed in the boost-pressure chambers can be fed into the at least one working chamber with an even higher boost-pressure.

In a first preferred design variant, the boost-pressure chamber is connected to the working chamber via a line which is located outside the housing and in which a valve, in particular a controllable valve, is preferably arranged.

The controllable valve may be, for example, a solenoid valve which is opened when a maximum boost pressure has been generated in the admission-pressure chamber.

Alternatively to the abovementioned embodiment, however, the boost-pressure chamber may also be connected directly to the working chamber through the piston, at least one valve, preferably an automatic valve, then being arranged in the piston.

The advantage of this measure is that a connecting line, located outside the housing, between the boost-pressure chamber and the working chamber may be dispensed with, with the result that the rotary piston machine occupies a smaller amount of space. The abovementioned automatic valve may be, for example, a flutter valve.

As an alternative or in combination with the previously mentioned embodiment of the rotary piston machine with at least one boost-pressure chamber and at least one working chamber it is, however, also preferred, if both end faces of the at least one piston is assigned a chamber in each case, which mutually reduce and enlarge in the opposite sense, wherein both chambers serve as working chambers for a Carnot-cycle.

This measure has the advantage that, for example, two cylinders of a conventional engine can be reproduced with only one piston, wherein a further particular advantage is that the expansion of the one working chamber after the ignition of the fuel/air mixture supports the compression of the other working chamber, which has just intaken new fuel/air mixture. In one of the previously mentioned preferred embodiments, according to which the rotary piston machine comprises four pistons in total, this embodiment is capable of reproducing a conventional six-cylinders-engine.

The rotary piston machine according to the invention may be used as an internal combustion engine or else as a compressor.

Further advantages and features may be gathered from the following description and the accompanying drawing.

It goes without saying that the features mentioned above and those still to be explained below may be used not only in the combination specified in each case, but also in other combinations or alone, without departing from the scope of the present invention.

BRIEF DESCRIPTION OF THE DRAWINGS

Exemplary embodiments of the invention are illustrated in the drawing and are described in more detail hereafter, with reference to the drawing in which:

FIGS. 9*a*) and *b*) show longitudinal sections, corresponding to FIGS. 6*a*) and 6*b*), of a rotary piston machine according to a further exemplary embodiment, in two operation positions;

FIGS. 10*a*) and *b*) show in each case a section along the line X—X in FIGS. 9*a*) and *b*);

FIGS. 11*a*) and *b*) show in each case a section along the line XI—XI in FIGS. 9*a*) and *b*);

DETAILED DESCRIPTION OF PREFERRED EMBODIMENTS

Figure 1:
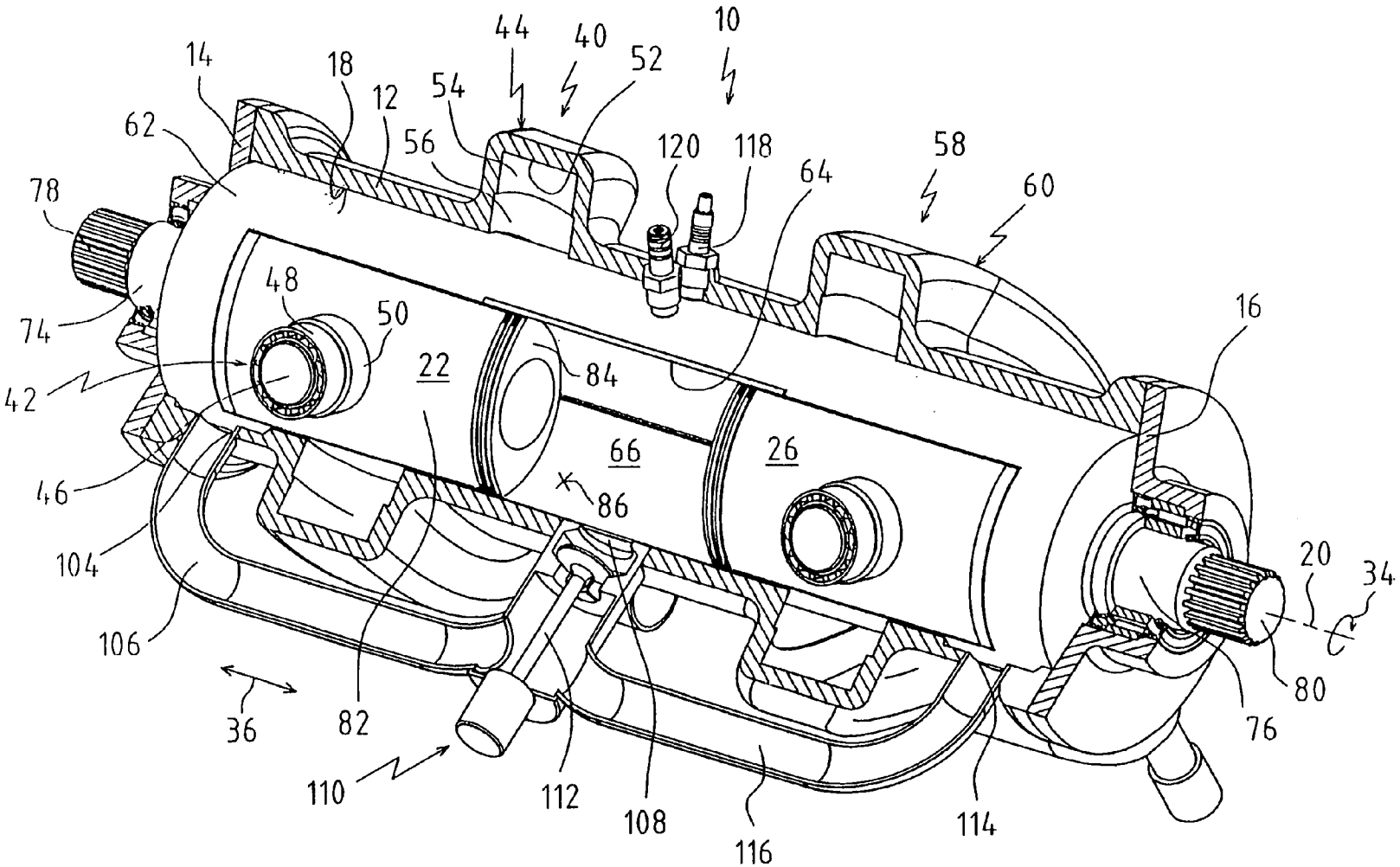
FIG. 1 shows a perspective, partially sectional illustration of a rotary piston machine according to a first exemplary embodiment in a first operating position.
Figure 2:
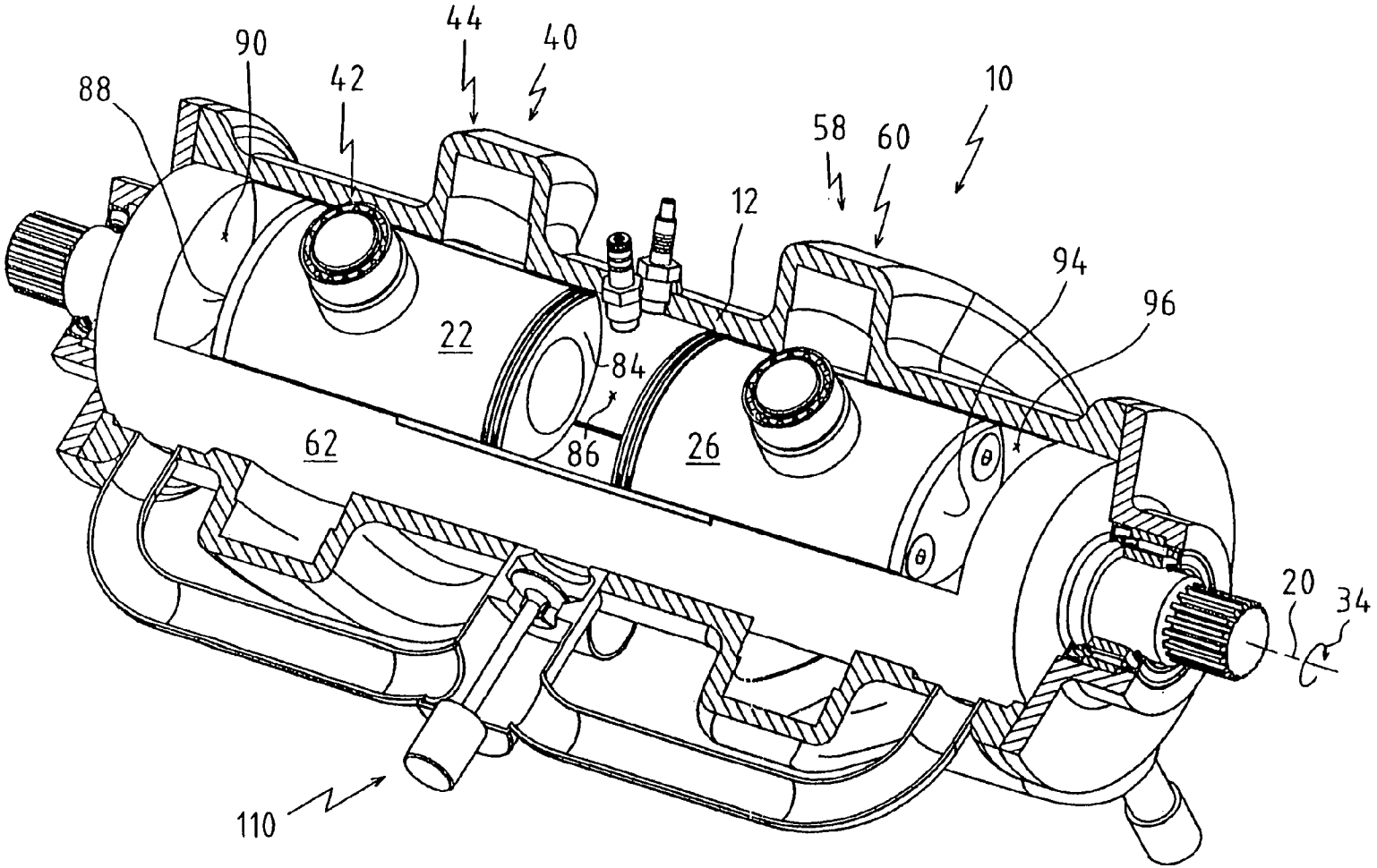
FIG. 2 shows the rotary piston machine in FIG. 1 in a second operating position.

FIGS. 1 to 8 illustrate a rotary piston machine, given the general reference symbol 10, according to a first exemplary embodiment.

The rotary piston machine 10 is used in the present case as an internal combustion engine.

The rotary piston machine 10 has a housing 12 which has an essentially cylindrically symmetrical basic shape. At its longitudinal ends, the housing 12 is closed by means of a housing cover 14 and a housing cover 16, although a different division of the housing 12 may also be considered, as may be gathered, for example, from FIG. 6*a*).

The housing 12 has a cylindrical housing inner wall 18 which therefore has a circular design in cross section.

A longitudinal mid-axis 20 forms the cylinder axis of the housing inner wall 18.

Figure 4:
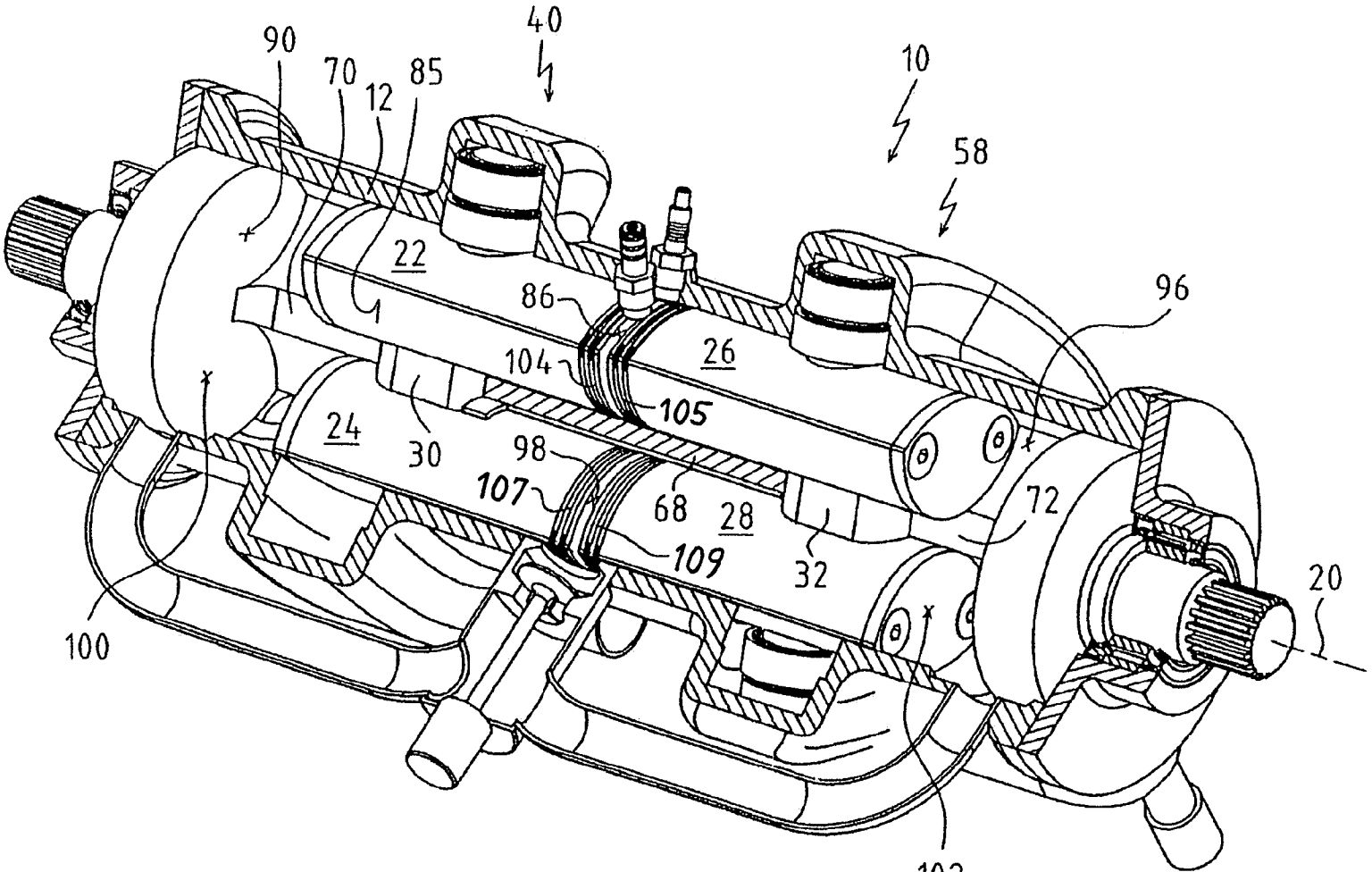
FIG. 4 shows the rotary piston machine in the operating position illustrated in FIG. 3, in a partially cut-away illustration.

The housing 12 has arranged in it at least one first piston 22 and, in the exemplary embodiment shown, a further second piston 24, which can be seen in the perspective illustrations in FIG. 4 only, a further third piston 26 and a further fourth piston 28, which likewise can be seen in the perspective illustration in FIG. 4 only.

Of the four pistons 22 to 26, in each case two pistons are firmly connected to one another to form a double piston, specifically these being the first piston 22 and the second piston 24, which form a first double piston, and the third piston 26 and the fourth piston 28, which form a second double piston. The first piston 22 is firmly connected to the second piston 24 via a first connection piece 30, and the third piston 26 is firmly connected to the fourth piston 28 via a second connection piece 32. The connection pieces 30 and 32 in each case make a rigid connection between the pistons 22, 24 and 26, 28 respectively.

The first piston 22 and the further pistons 24 to 28 rotate in the housing 12 jointly about the longitudinal mid-axis 20 according to an arrow 34, so that the longitudinal mid-axis 20 may also be designated as the axis of rotation.

During rotation about the longitudinal mid-axis 20 of the housing 12, the first piston 22 and the further pistons 24 to 28 execute to-and-fro linear movements by means of a control mechanism still to be described later, these linear movements being directed parallel to the longitudinal mid-axis 20, as is indicated by a double arrow 36.

The four pistons 22 to 28 are in each case arranged eccentrically with respect to the longitudinal mid-axis 20 of the housing 12, as may be gathered from the cross-sectional illustrations in FIGS. 7*a*) to 7*d*).

The further second piston 24 and the further fourth piston 28 are arranged opposite the first piston 22 with respect to the longitudinal mid-axis 20, that is to say on that side of the longitudinal mid-axis 20 which faces away from the first piston 22. In this case, the further second piston 24 is arranged opposite the first piston 22 at the same height axially, whilst the further fourth piston 28 is arranged opposite the first piston 22 with an axial offset. The further third piston 26 is arranged in the housing in the rectilinear prolongation of the first piston 22, that is to say is located in the same circumferential position as the first piston 22 with respect to the longitudinal mid-axis 20. By contrast, the second piston 24 and the fourth piston 28 are arranged with an offset of 180° in the circumferential direction with respect to the first piston 22 and to the third piston 26.

Since the first piston 22 is firmly connected to the further second piston 24, the first piston 22 and the second piston 24, during rotation in the housing 12, execute linear movements in the same direction parallel to the longitudinal mid-axis 20. Likewise, by virtue of their firm connection by means of the connection piece 32, the further third piston 26 and the further fourth piston 28, during rotation in the housing 12, execute linear movements directed in the same direction.

By contrast, the relative linear movements between the first piston 22 and the second piston 24, on the one hand, and the third piston 26 and the fourth piston 28, on the other hand, are directed opposite to one another. In other words, the pistons 22, 24, on the one hand, and the pistons 26 and 28, on the other hand, move either towards one another or away from one another. However, all four pistons 22 to 28 do not change their rotary position in relation to one another during rotation about the longitudinal mid-axis 20.

The four pistons 22 to 28 are designed identically to one another in terms of their geometry and dimensions. By the four pistons 22 to 28 being arranged axially symmetrically with respect to the longitudinal mid-axis 20, the centrifugal forces occurring during the rotation of the pistons 22 to 28 about the longitudinal mid-axis 20 compensate one another completely. Furthermore, in the rotary piston machine 10, the inertias occurring during the linear movement of the pistons 22 to 28 also compensate one another, because the first double piston formed from the pistons 22 and 24 moves in the housing 12 linearly in the opposite direction to the second double piston formed from the pistons 26 and 28.

As already mentioned, to derive the linear movement of the individual pistons 22 to 28 from their rotational movement about the longitudinal mid-axis 20, a control mechanism is provided, which is given the general reference symbol 40 in FIGS. 1 to 4 and 6 and is described below solely with regard to the piston 22.

The control mechanism 40 comprises a guide member 42 arranged on the first piston and a control cam curve 44 which is formed in the housing inner wall 18 and along which the guide member 42 runs.

The guide member 42 is connected firmly to the first piston 22 and has an axle journal 46 and also a first running roller 48 fastened to the axle journal 46 and a second running roller 50. The first running roller 48 has a smaller outside diameter than the second running roller 50.

The control cam curve 44 is designed in the form of a guide groove 52 formed in the housing inner wall 18. The guide groove 52 in this case has a portion 54 of smaller diameter and a portion 56 of larger inside diameter, corresponding to the outside diameter of the first running roller 48 and to the outside diameter of the second running roller 50. The provision of first running roller 48 and second running roller 50 of different diameter, which run in the corresponding portions 54 and 56 of the guide groove 52, ensures that each running roller 48 and 50 has only one direction of rotation about the axle journal 46 when it runs in the guide groove 52, that is to say that the running roller 48 and the running roller 50, which correspondingly come to bear on only one side of their respectively assigned portion 54 and 56, do not experience any reversal of rotation while they are rotating in the guide groove 52.

The control cam curve 44 in the form of the guide groove 52 extends over the full circumference about the longitudinal mid-axis 20 and constitutes a closed control cam curve which, in order to derive the linear movement of the pistons 22 to 28 from the rotational movement of the latter about the longitudinal mid-axis 20, has a correspondingly curved shape which is approximately in the form of a circle curved about a diameter. The lead of the control cam curve 44 along the longitudinal mid-axis 20 determines the stroke of the piston 22.

As will be gathered from FIG. 6*a*), the second piston 24 is equipped with a guide member which is designed identically to the guide member 42 and on which two running rollers are arranged correspondingly, the guide member 42 running along the same control cam curve 44, that is to say in the same guide groove 52. The control mechanism 40 thus constitutes a common control mechanism for the double piston formed from the pistons 22 and 24.

As may likewise be gathered from FIG. 6*a*), the running rollers 48 and 50 and, correspondingly, the guide groove 52 may also be designed conically.

A corresponding control mechanism 58 is provided for the further double piston formed from the pistons 26 and 28 and differs from the control mechanism 40 merely in that a control cam curve 60 is formed mirror-symmetrically in relation to the control cam curve 44 of the control mechanism 40, with respect to the cross-sectional mid-plane of the housing 12.

Figure 5:
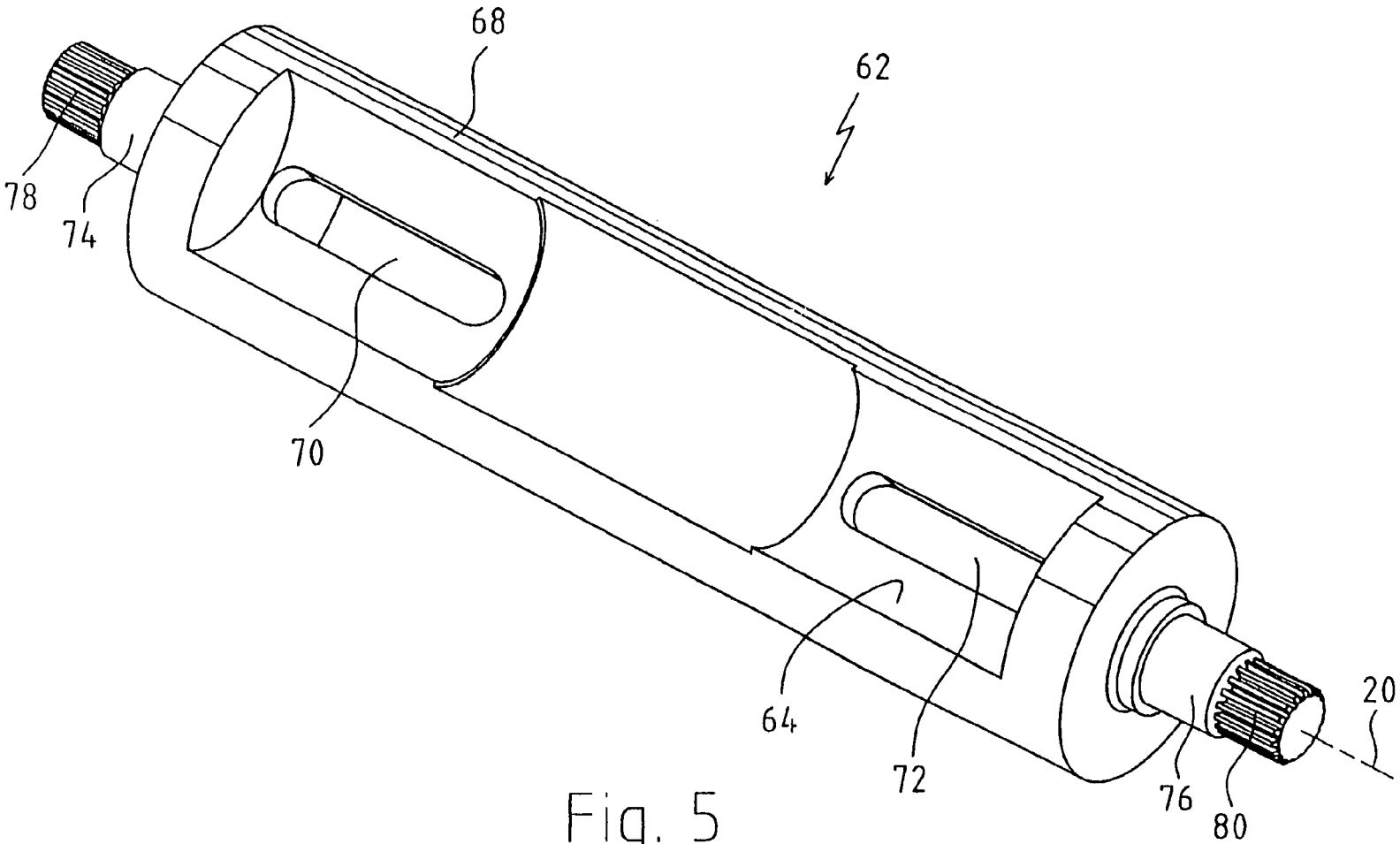
FIG. 5 shows a perspective illustration of an individual part of the rotary piston machine in FIGS. 1 to 4.

The pistons 22 to 28 are guided in their linear movement by a rotor 62 which is illustrated alone in FIG. 5.

The rotor 62 has, in general, a cylindrical shape which is adapted to the inner wall 18 of the housing 12 of the rotary piston machine 10.

For receiving the pistons 22 to 28, the rotor 62 has two trough-like recesses 64 and 66 (cf., for example, FIG. 8*a*)) which are offset at 180° with respect to the longitudinal mid-axis 20 and only the recess 64 of which can be seen in FIG. 5. Those walls of the trough-like recesses 64 and 66 which are located opposite one another are designed in the form of a part-circle in cross section. Between the recesses 64 and 66, the rotor 62 has a base or a middle portion 68 which separates the recesses 64 and 66 from one another. Furthermore, two long holes 70 and 72, through which the connection pieces 30 and 32 (cf. FIG. 4) pass, are cut out in the middle portion 68. Instead of the long holes 70 and 72, the middle portion 68 can also have otherwise shaped cut-outs there, or the middle portion 68 can be completely absent in this region, i.e. it can extend only through an intermediate partial region with respect to the longitudinal direction of the rotor 62.

The rotor 62 is circular, as seen in cross section, the two recesses 64 and 66 extending approximately over 90° in the circumferential direction with respect to the longitudinal mid-axis 20. The middle portion 68 of the rotor 62 likewise extends at each of its wide ends approximately over 90° or a quarter of the full circumference.

The middle portion 68 of the axially immovable rotor 62, by means of which the pistons 22 to 28 rotate jointly, lies centrically on the longitudinal mid-axis 20 of the housing 12. Provided on the rotor, on the end faces, are shaft extensions 74 and 76, via which the rotor 62 is mounted rotatably in the housing 12, more precisely in the housing covers 14 and 16. In the exemplary embodiment shown, the shaft extension 74 projects with a toothed end piece 78 out of the housing 12, and the shaft extension 76 likewise projects with a toothed end piece 80 out of the housing. There may also be provision, however, for the end piece 80 to be omitted and for the housing cover 16 to be designed to be closed via the shaft extension 76. The rotational movement of the rotor 62 can be picked up as rotational energy via the end piece 78 and/or the end piece 80, that is to say the end piece 78 and/or the end piece 80 may serve as an output shaft.

Moreover, measures, for example supporting rollers, may be provided on the rotor 62, in order, in the case of a long overall length, to support the rotor 62 against transverse forces in the housing 12.

As described below with regard to the piston 22, each of the pistons 22 to 28 has a side 82 which faces the housing inner wall 18 and which is designed in cross section in the form of a part-circle, so that each of the pistons 22 to 28 is adapted on the outside to the housing inner wall 18. The side 82 in this case extends over an angle of circle of about 90°.

One side 85 of each piston 22 to 28, the said side facing away from the side 82 and facing the longitudinal mid-axis 20, is likewise designed in cross section in the form of a part-circle, the circle centre of which is spaced apart from the circle centre of the part-circle which in each case forms the side 82 of the pistons 22 to 28. Each piston 22 thus has in cross section an approximately almond-shaped or lenticular shape.

Each of the pistons 22 is assigned at least one chamber which is periodically reduced and enlarged in volume as a result of the to-and-fro linear movement of the pistons 22 to 28.

A first chamber 86 is assigned to the first piston 22 on one end face 84. A second chamber 90 is assigned to the piston 22 on an end face 88 arranged opposite the end face 84. The chamber 86 is assigned, in turn, to the third piston 26 on an end face 94 facing the end face 84 of the first piston 22, 50 that the chamber 86 is assigned jointly to both pistons 22 and 26. A further chamber 96 is assigned to the piston 26 on an end face 94 facing away from the end face 94. By virtue of the oppositely directed linear movements of the pistons 22 and 26 in relation to one another, the volumes of the chambers 90 and 96 are reduced when the volume of the chamber 86 is enlarged, and vice versa.

Correspondingly, the pistons 24 and 28 are assigned chambers 98, 100 and 102 which are arranged with an offset of 180° in relation to the chambers 86, 90 and 96 with respect to the longitudinal mid-axis 20.

The chambers 86 and 98 are separated from one another completely by the middle portion 68 of the rotor 62. The chamber 86 is separated completely from the chambers 90 and 96 by means of a seal 104, which seals off the piston 22 relative to the housing inner wall 18 and to the middle portion 68 of the rotor 62, and a seal 105, which seals off the piston 26 relative to the housing inner wall 18 and to the middle portion 68 of the rotor 62.

Correspondingly, the chamber 98 is separated completely from the chambers 100 and 102 via seals 107 and 109 on the pistons 24 and 28.

By contrast, the chambers 90 and 100 communicate with one another via the long hole 70, and the chambers 96 and 102 also communicate with one another via the long hole 72; this, however, can also be modified according to an embodiment to be described later in such a way that the chambers 90 and 100 or 96 and 102, respectively, do not communicate with one another. As already mentioned above, the long holes 70 and 72 can also be shaped differently, or the middle portion 68 can be absent at these locations, whereby the chambers 90 and 100 as well as 96 and 102 also communicate with one another and, in each case, form a double total volume.

In the exemplary embodiment illustrated in FIGS. 1 to 6, the chambers 86 and 98 serve as working chambers for a Carnot cycle, and the chambers 90, 100 and 96, 102 serve as boost-pressure chambers for generating a boost pressure which can act upon the working chambers 86 and 98.

For this purpose, the chambers 90 and 100 are connected to the chambers 86 and 98 via an orifice 104 in the housing 12 and a connecting line 106, depending on which of the chambers 86 or 98 is exactly opposite an inlet orifice 108 during the rotational movement of the pistons 22 to 28 about the longitudinal mid-axis 20. Arranged in the inlet orifice 108 is a valve 110 which is designed as a controllable valve, in particular a solenoid valve, 112. The chambers 96 and 102 are correspondingly connected to the inlet orifice 108, with the valve 110 interposed, via an orifice 114 and a connecting line 116.

The chambers 86 and 98 serving as working chambers are assigned, overall, a spark plug 118 for the discharge of ignition sparks and an injection nozzle 120 for the injection of a fuel, for example petrol, diesel or biodiesel.

According to FIGS. 7*a*) to *d*), an outlet orifice 122 for the expulsion of the burnt fuel/air mixture is also assigned to the chambers 86 and 98 in the housing.

According to FIGS. 8*a*) to *d*), the chambers 96 and 102 serving as boost-pressure chambers are assigned, furthermore, a common intake orifice 124, a corresponding intake orifice, not illustrated in any more detail, in the housing 12 being assigned to the chambers 90 and 100 likewise serving as boost-pressure chambers.

Figures 6, 7, 8:
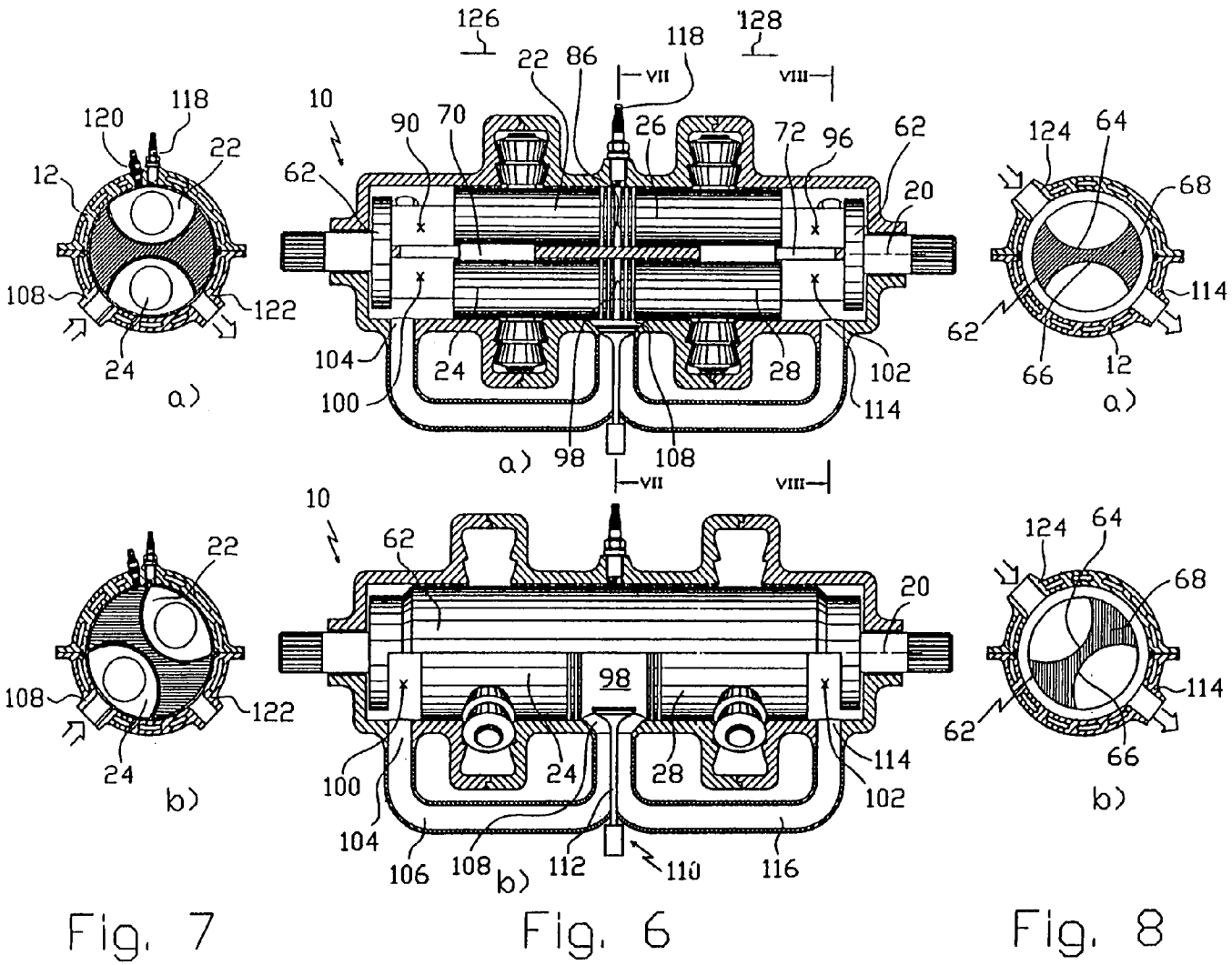
FIGS. 6*a*) to *d*) show a longitudinal section through the rotary piston machine in FIGS. 1 to 4 in four different operating positions.
FIGS. 7*a*) to *d*) show in each case a section along the line VII—VII in FIGS. 6*a*) to *d*)
FIGS. 8*a*) to *d*) show sections along the lines VIII—VIII in FIGS. 6*a*) to *d*)
Figures 6, 7, 8:
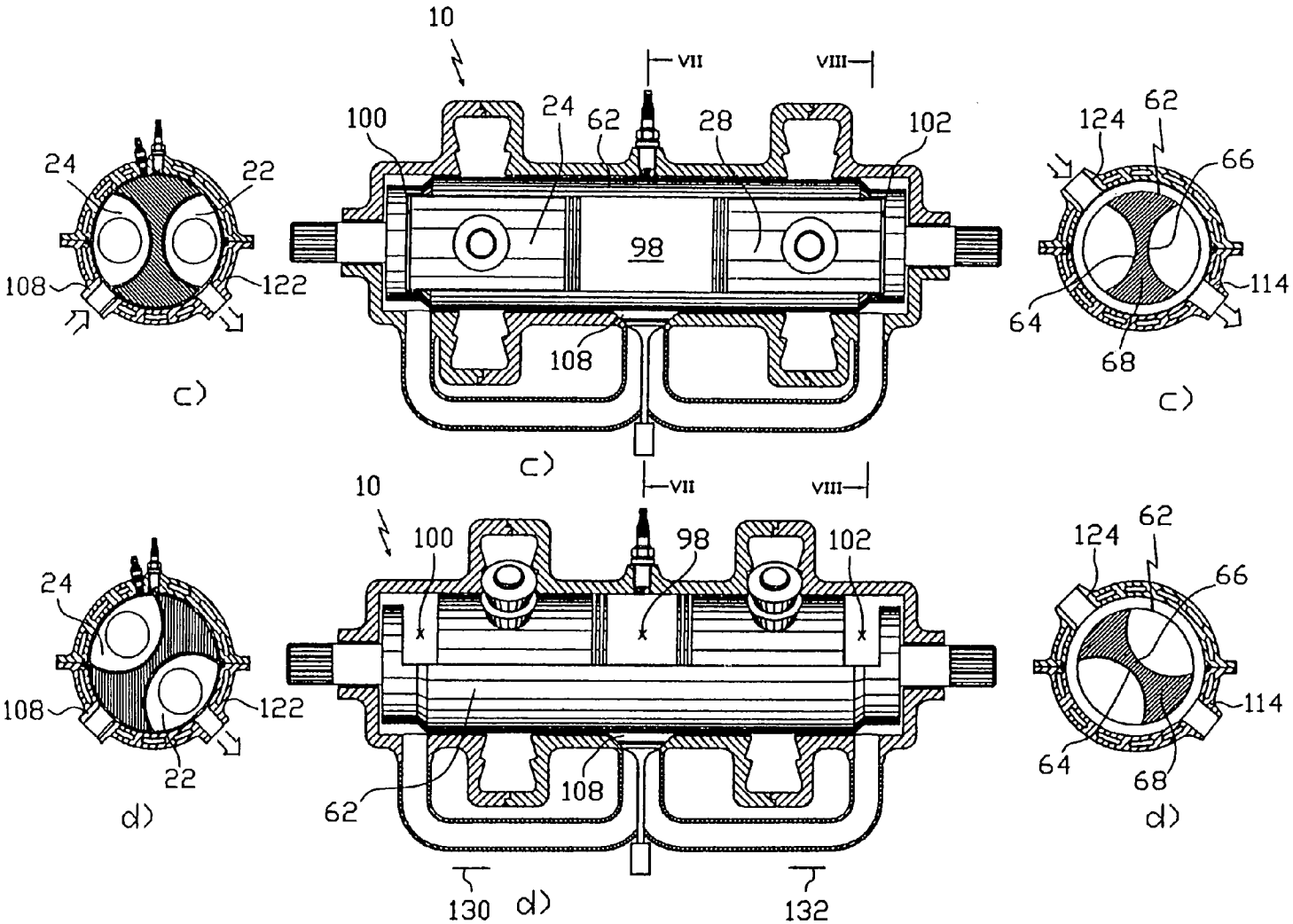

The functioning of the rotary piston machine 10 is described in more detail below with reference to FIGS. 6 to 8.

Figure 3:
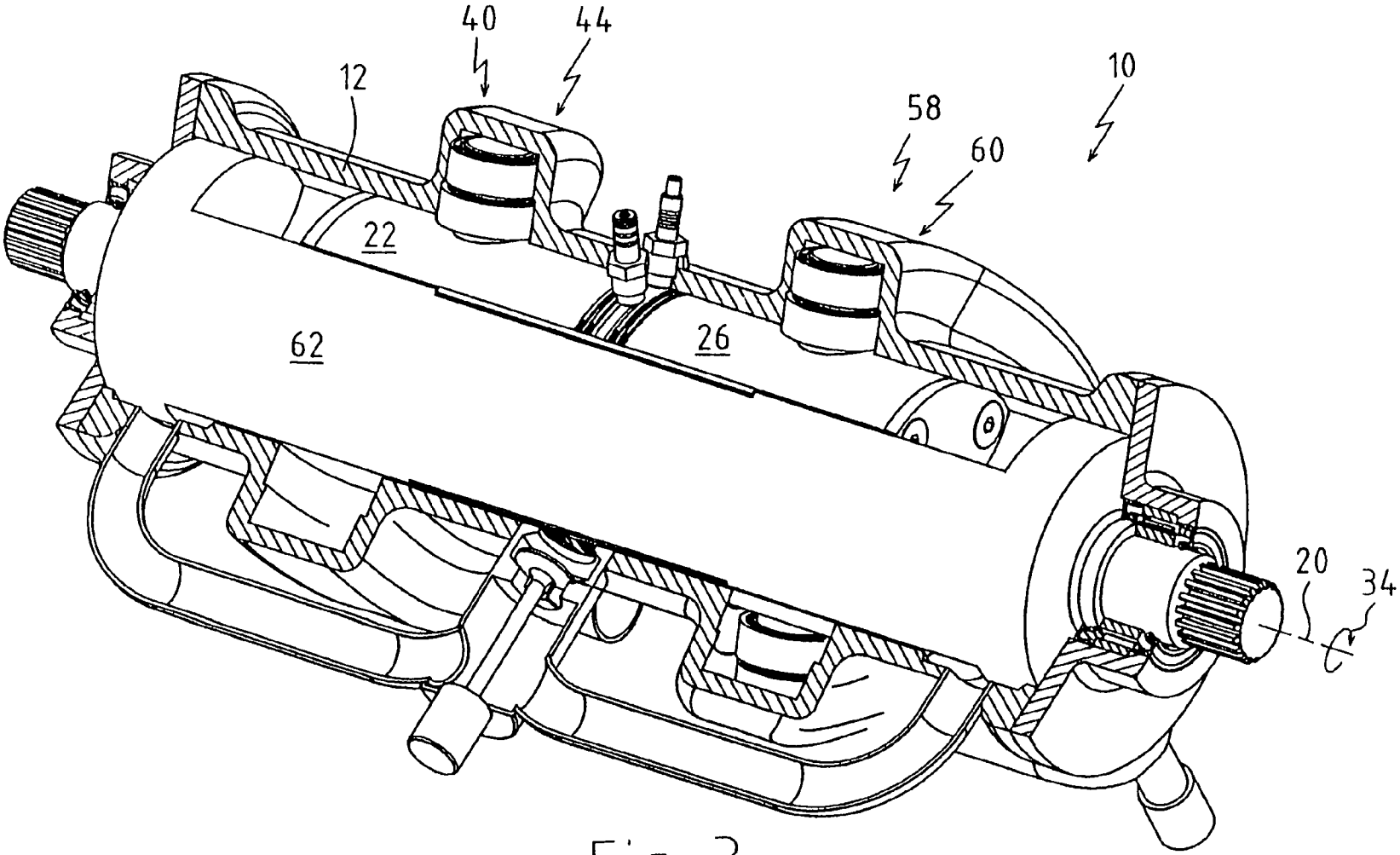
FIG. 3 shows the rotary piston machine in FIGS. 1 and 2 in a third operating position.

FIGS. 6*a*), 7*a*) and 8*a*) illustrate the rotary piston machine in a first operating position which corresponds to the operating position in FIG. 3 and FIG. 4. The fuel/air mixture, which is compressed to the maximum extent, is just being ignited in the chamber 86 via the spark plug 118. Burnt fuel/air mixture has just been expelled completely from the chamber 98. The chambers 96, 102 serving as boost-pressure chambers have been filled completely with air through the intake orifice 124, in which a corresponding valve, preferably an automatic valve, for example a flutter valve, may be arranged. The chambers 90 and 100 serving as boost-pressure chambers have likewise been filled completely with fresh air through a corresponding intake orifice.

Starting from FIGS. 6*a*), 7*a*) and 8*a*), the pistons 22 to 28 rotate clockwise, together with the rotor 62, about the longitudinal mid-axis 20 and have been rotated through about 45° with respect to the operating position in FIGS. 6*b*), 7*b*) and 8*b*) (cf. FIG. 1). The fuel/air mixture previously ignited in the chamber 86 then expands in the chamber 86 which is enlarged in volume, whilst fresh air is forced into the chamber 98 from the boost-pressure chambers 90, 100 and 96, 102, which are reduced in volume and thereby compress the fresh air previously introduced. As illustrated in FIG. 6*b*), the valve 110 is opened, in order to admit the precompressed fresh air into the chamber 98 from the chambers 90, 100 and 96, 102 serving as boost-pressure chambers. Since the maximum volume of the chambers 90, 96, 100, 102 together is larger than the maximum volume of the chamber 98, namely about four times as large, a (pre) compression of the air forced into the chamber 98 occurs.

Meanwhile, the pistons 22 and 24 move parallel to the longitudinal mid-axis 22 according to an arrow 126 and the pistons 26 and 28 move in the opposite direction parallel to the longitudinal mid-axis 20 according to an arrow 128. The longitudinal movement of the pistons 22, 24 and 26, 28 is imparted by means of the control mechanisms 40 and 58.

After a further rotation of the pistons 22 to 28 through 45° about the longitudinal mid-axis 20, the operating position illustrated in FIGS. 6*c*), 7*c*) and 8*c*) (cf. FIG. 2) is reached, in which the chamber 98 has attained its maximum volume and is filled with precompressed fresh air, whilst, after the complete expansion of the previously ignited fuel/air mixture, the opposite chamber 86, which cannot be seen in the drawing, likewise assumes its largest volume. By contrast, the chambers 90, 100 and 96, 102 then have their minimum volume.

As a result of a further rotation of the pistons 22 to 28 through 45°, the operating position assumed in FIGS. 6*d*), 7*d*) and 8*d*) is reached, in which the fresh air previously admitted into the chamber 98 is then further compressed continuously, in that the pistons 24, 28 move towards one another again in opposite directions according to the arrows 126 and 128. In the chamber 86, which cannot be seen in FIGS. 6*d*), 7*d*) and 8*d*) and which is then likewise reduced in volume again because the pistons 22 and 26 likewise move towards one another according to the arrows 126 and 128, the completely expanded fuel/air mixture is then expelled from the outlet orifice 122 as a result of a reduction in volume of the chamber 86. Fresh air is correspondingly sucked from outside into the chambers 90, 100 and 96, 102, which are then enlarged in volume again.

After a further rotation of the pistons 22 to 28 through 45°, starting from FIGS. 6*d*), 7*d*) and 8*d*), the state illustrated in FIGS. 6*a*), 7*a*) and 8*a*) is assumed again, but the pistons 24 and 28 then lie "at the top" and the pistons 22 and 26 lie "at the bottom". In other words, up to then, the pistons 22 to 28 have executed, overall, a rotation through 180° about the longitudinal mid-axis 20, and at the same time have passed once through the four working strokes of admission, compression, expansion and expulsion. Accordingly, during one full revolution of the pistons 22 to 28 through 360° about the longitudinal mid-axis 20, two full working cycles are completed.

FIGS. 9*a*) and *b*), 10*a*) and *b*) and 11*a*) and *b*) illustrate an exemplary embodiment of a rotary piston machine 10' which is slightly modified in relation to the exemplary embodiment described above and which differs from the rotary piston machine 10 in the following features.

The chambers 90' and 100' which are assigned to the pistons 22' and 24' and which again serve as boost-pressure chambers for acting upon the chambers 86' and 98' with a boost-pressure generated in the chambers 90' and 100', the chambers 90' and 100' again communicating with one another, are not connected to the chamber 86' and 98' via lines located on the outside of the housing, but directly via the pistons 22' and 24'. For this purpose, the pistons 22' and 24' have a hollow design, and the pistons 22' and 24' have arranged in them in each case a valve 138 which is designed as an automatic valve, preferably as a flutter valve.

Correspondingly, the chambers 96' and 102' assigned to the pistons 26' and 28' and likewise communicating with one another are connected directly to the chambers 86' and 98' via valves 140 present in the pistons 26' and 28'.

Whilst the valves 138, 140 are shown in their closing position in FIG. 9*a*), the pistons 22' to 28' moving into their position displaced to the greatest possible extent towards the middle of the housing 12', the valves 138 and 140 are shown in their open position in FIG. 9*b*), when the pistons 22' to 28' move apart from one another in opposite directions and the chambers 90', 100' and 96' and 102' are reduced in volume. In this way, the chamber 96' provided for intake between the pistons 24' and 28' can be supplied with precompressed air from the chambers 90', 100' and 96', 102'.

Figures 12, 13, 14, 15:
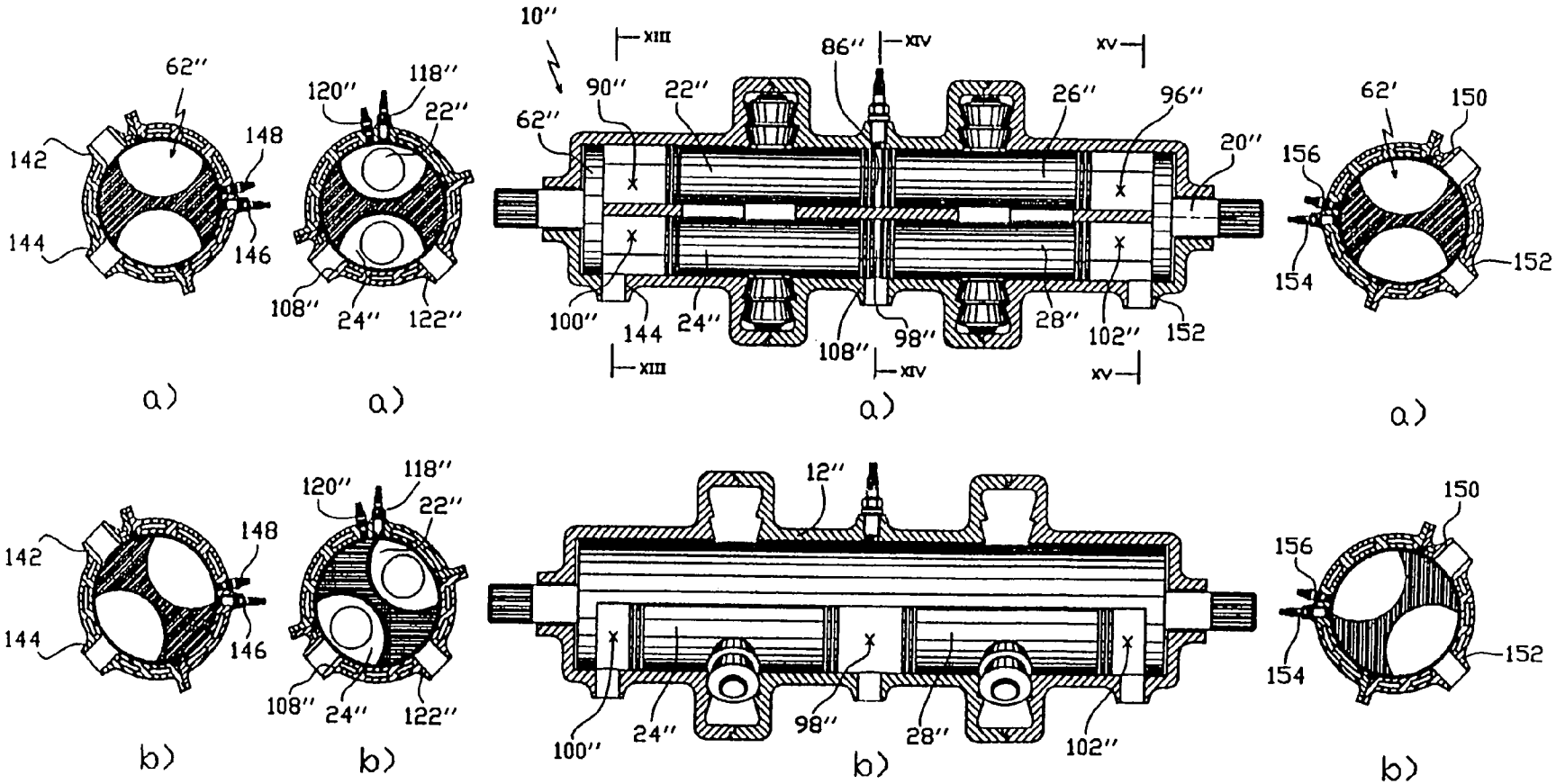
FIGS. 12*a*) to *d*) show a longitudinal section corresponding to FIGS. 6*a*) to 6*c*) through a rotary piston machine according to another embodiment in four different operating positions.
FIGS. 13*a*) to *d*) show in each case a section along the line XIII—XIII in FIGS. 12*a*) to *d*)
FIGS. 14*a*) to *d*) show in each case a section along the line XIV—XIV in FIGS. 12*a*) to *d*)
FIGS. 15*a*) to *d*) show in each case a section along the line XV—XV in FIGS. 12*a*) to *d*).
Figures 12, 13, 14, 15:
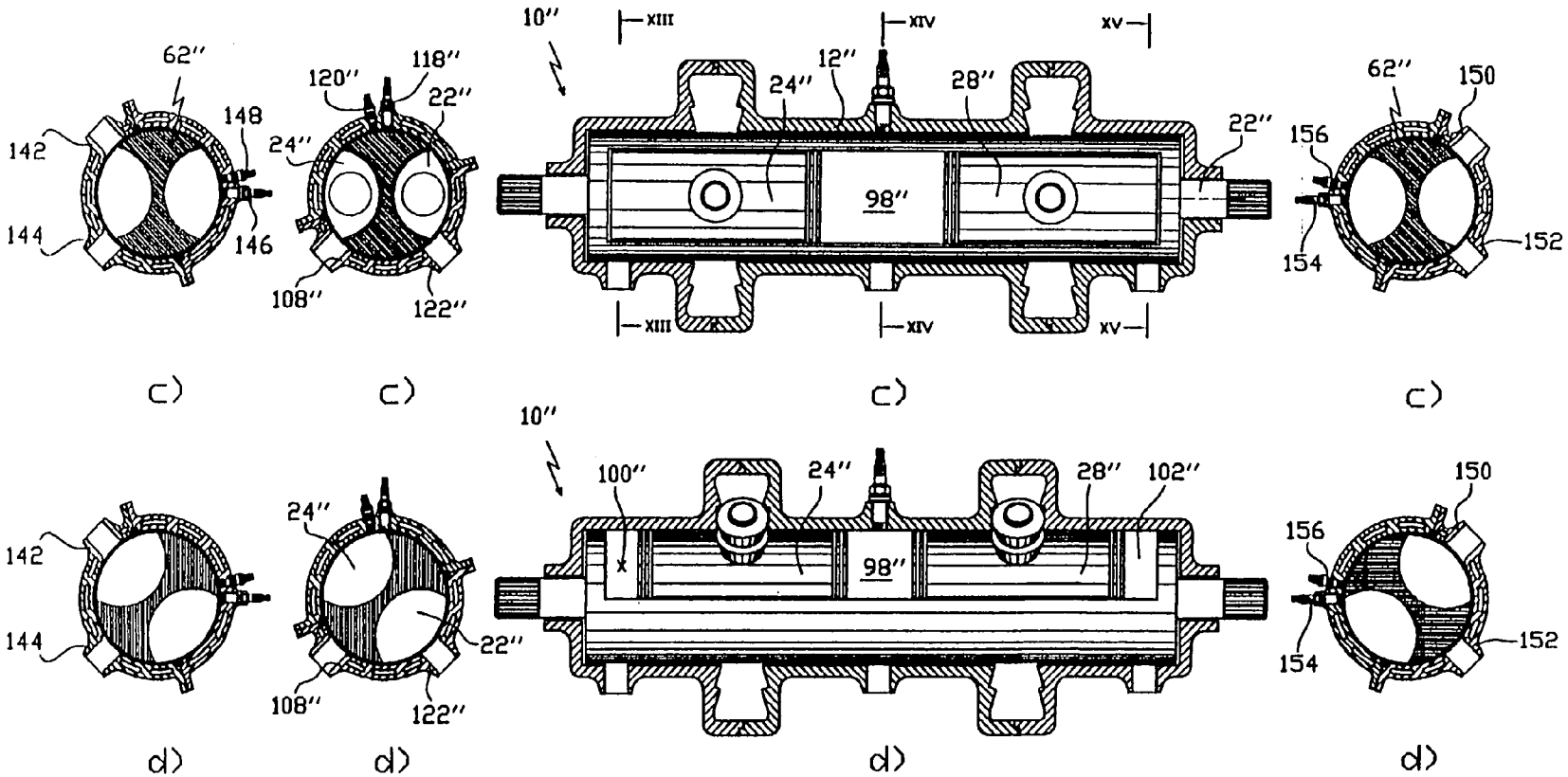

FIGS. 12*a*)–*d*) to 15*a*)–*d*) show another embodiment of a rotary piston machine labelled with the general reference symbol 10" which differs from the rotary piston machine 10 with respect to the following features.

The rotary piston machine 10" likewise comprises four pistons 22" to 28" which are assigned chambers 86", 90", 96", 98", 100" and 102". Differently from the rotary piston machine 12 and also from the rotary piston machine 10', however, the chambers 90", 96", 100" and 102" do not serve as boost-pressure chambers, but also as working chambers for a Carnot-cycle like the chambers 86" and 98".

As a further difference to the previous embodiments, the chambers 90" and 100" do not communicate with one another, but are completely separated from one another by the middle portion 68" of the rotor 62". Likewise, the chambers 96" and 102" are completely separated from one another by the middle portion 68" of the rotor 62" and also serve as working chambers for a Carnot-cycle.

The chambers 90" and 100" are assigned an inlet channel 142 for fresh air and an outlet channel 144 for expelling the burnt fuel/air mixture, accordingly. Further the chambers 90" and 100" are assigned another spark plug 146 and another injection nozzle 148, in common. The inlet channel 142, the outlet channel 144, the spark plug 146 as well as the injection nozzle 148 are arranged offset by 90° about the longitudinal mid-axis 20" with respect to the corresponding inlet channel 108", outlet channel 122", the spark plug 118" and the injection nozzle 120", which are assigned to the chambers 86" and 98".

In the same way, the chambers 96" and 102" are assigned another inlet channel 150, outlet channel 152, a spark plug 154 and an injection nozzle 156, which are situated on the same peripherical position as the inlet channel 142, the outlet channel 144, the spark plug 146 and the injection nozzle 148 which are assigned to the chambers 90" and 100".

With this construction, a six-cylinder-engine is reproduced by the rotary piston machine 10", wherein the working strokes of admission, compression, expansion and expulsion are offset by 90° in the chambers 90", 100" as well as 96", 102" with respect to the corresponding working strikes in the chambers 86" and 98".

FIGS. 12*a*)–*d*) to 15*a*)–*d*) show four operational positions of the rotary piston machine 10" in which the pistons 22" to 28" have moved by 135° in total about the longitudinal mid-axis 20". Upon a full revolution of the pistons 22" to 28" by 360° about the longitudinal mid-axis 20" a full working stroke in each case is carried out in the chambers 86" and 98", and also in each case in the chambers 90" and 100" as well as 96" and 102" so that altogether six complete working strokes are performed in the rotary piston machine 10" upon a full revolution.

It is to be understood that further modifications of the rotary piston machine 10, 10' or 10" are possible within the scope of the present invention.

For example, it is conceivable to provide only the pistons 22 and 24 as a double piston in the rotary piston machine 10, whereas the pistons 26 and 28 may be omitted. In this case, however, the linear movement of the pistons 22 and 24 would not be mass-compensated. On the other hand, only the piston 22 and the piston 28 may be provided, whilst the pistons 24 and 26 would be omitted, corresponding transverse walls for delimiting the chambers 86 and 98 being provided in the rotor 62. Such an arrangement would again lead to a mass-compensated configuration also with respect to the linear movement of the pistons 22 and 28.

What is claimed is:

1. A rotary piston machine, comprising:

a housing having a cylindrical housing inner wall and a longitudinal mid-axis;

at least one piston arranged in said housing, said at least one piston rotating about said longitudinal mid-axis when the rotary piston machine is operating and at the same time executing, via a control mechanism, a to-and fro linear movement parallel to said longitudinal mid-axis;

at least one chamber in said housing assigned to said at least one piston which periodically enlarges and reduces due to said to-and-fro linear movement of said at least one piston;

wherein a side of said at least one piston, which side faces said housing inner wall, is designed in cross section in the form of a part-circle which extends over an angle of circle of about 90°.

2. A rotary piston machine, comprising:

a housing having a cylindrical housing inner wall and a longitudinal mid-axis;

at least one piston arranged in said housing, said at least one piston rotating about said longitudinal mid-axis when the rotary piston machine is operating and at the same time executing, via a control mechanism, a to-and fro linear movement parallel to said longitudinal mid-axis;

at least one chamber in said housing assigned to said at least one piston which periodically enlarges and reduces due to said to-and-fro linear movement of said at least one piston;

wherein said housing has arranged in it at least one further piston opposite to said at least one piston, wherein an end face of said at least one piston is assigned said at least one chamber, and wherein an end face of said at least one further piston is assigned a further chamber, said chamber and said at least one further chamber serving as boost-pressure chambers which communicate with one another.

3. The rotary piston machine of claim 2, wherein said at least one piston has two end faces, and wherein said two end faces is assigned said at least one chamber and one further chamber which chambers enlarge and reduce mutually with respect to one another, wherein one chamber serves as working chamber for a Carnot cycle and another chamber serves as boost-pressure chamber for generating boost-pressure in order to supply said working chamber with boost-pressure, and wherein said boost-pressure chamber is connected to said working chamber via a connecting line which is located on an outside of said housing.

4. The rotary piston machine of claim 3, wherein a controllable valve is arranged in said connecting line.

5. A rotary piston machine, comprising:

a housing having a cylindrical housing inner wall and a longitudinal mid-axis;

at least one piston arranged in said housing, said at least one piston rotating about said longitudinal mid-axis when the rotary piston machine is operating and at the same time executing, via a control mechanism, a to-and fro linear movement parallel to said longitudinal mid-axis;

at least one chamber in said housing assigned to said at least one piston which periodically enlarges and reduces due to said to-and-fro linear movement of said at least one piston;

wherein said at least one piston is arranged eccentrically with respect to said longitudinal mid-axis of said housing, and said housing having arranged in it at least one further piston which rotates about said longitudinal mid-axis and which is arranged, with respect to said longitudinal mid-axis of said housing, on a side located opposite said at least one piston.

6. The rotary piston machine of claim 5, wherein said at least one further piston is arranged opposite said at least one piston at a same axial position along said longitudinal mid-axis.

7. The rotary piston machine of claim 6, wherein said at least one further piston is firmly connected to said at least one piston.

8. The rotary piston machine of claim 5, wherein said at least one piston is arranged centrically about said longitudinal mid-axis, and rotates about a piston mid-axis coinciding with said longitudinal mid-axis in said housing.

9. The rotary piston machine of claim 5, wherein said housing has arranged in it at least one further piston which rotates about said longitudinal mid-axis and which is arranged in rectilinear prolongation of said at least one piston.

10. The rotary piston machine of claim 9, wherein said at least one chamber is formed by a space between mutually confronting end faces of said at least one piston and said at least one further piston.

11. The rotary piston machine of claim 5, wherein said housing having arranged in it at least one further piston which rotates about said longitudinal mid-axis and executes a to-and-fro linear movement, wherein said linear movement of said at least one further piston is directed opposite to said linear movement of said at least one piston.

12. The rotary piston machine of claim 5, wherein said housing has arranged in it at least four pistons, of which in each case two pistons are arranged opposite one another at a same axial position along said longitudinal mid-axis of said housing and in each case two pistons are arranged in rectilinear prolongation of one another.

13. The rotary piston machine of claim 5, wherein said control mechanism comprises at least one guide member arranged on said at least one piston and at least one control cam curve which is formed in said housing inner wall and along which said guide member runs.

14. The rotary piston machine of claim 5, wherein said housing has arranged in it at least one further piston, and wherein said control mechanism comprises at least one guide member arranged on said at least one piston and at least one further guide member arranged on said at least one further piston, said at least one guide member and said at least one further guide member running along a common control cam curve of said control mechanism.

15. The rotary piston machine of claim 5, wherein a side of said at least one piston which side faces said housing inner wall, is designed in cross section in the form of a part-circle which extends over an angle of circle of about 90°.

16. The rotary piston machine of claim 5, wherein said at least one piston is guided in said linear movement by a rotor which rotates jointly with said at least one piston about said longitudinal mid-axis and which is axially immovable.

17. The rotary piston machine of claim 16, wherein said rotor is configured as a sleeve or as an axle.

18. The rotary piston machine of claim 5, wherein said at least one piston is guided in said linear movement by a rotor which rotates jointly with said at least one piston about said longitudinal mid-axis and which is axially immovable, and wherein said rotor has a middle portion which lies on said longitudinal mid-axis of said housing and which separates said chamber assigned to said at least one piston from a chamber assigned to at least one further piston arranged in said housing opposite with respect to said longitudinal mid-axis.

19. The rotary piston machine of claim 5, wherein said at least one piston has two end faces, and wherein said two end faces is assigned said at least one chamber and one further chamber which chambers enlarge and reduce mutually with respect to one another, wherein one chamber serves as working chamber for a Carnot cycle and the other chamber serves as boost-pressure chamber for generating boost-pressure in order to supply said working chamber with boost-pressure.

20. The rotary piston machine of claim 5, wherein said housing has arranged in it at least one further piston opposite to said at least one piston, wherein an end face of said at least one piston is assigned said at least one chamber, and wherein an end face of said at least one further piston is assigned a further chamber, said chamber and said at least one further chamber serving as boost-pressure chambers which communicate with one another.

21. The rotary piston machine of claim 5, wherein said at least one piston has two end faces, and wherein said two end faces is assigned said at least one chamber and one further chamber which chambers enlarge and reduce mutually with respect to one another, wherein one chamber serves as working chamber for a Carnot cycle and the other chamber serves as boost-pressure chamber for generating boost-pressure in order to supply said working chamber with boost-pressure, and wherein said boost-pressure chamber is connected to said working chamber directly through said at least one piston.

22. The rotary piston machine of claim 21, wherein at least one valve is arranged in said at least one piston.

23. The rotary piston machine of claim 5, wherein said at least one piston has two end faces and wherein said two end faces is assigned said at least one chamber and one further chamber which chambers reduce and enlarge mutually with respect to one another, wherein both chambers serve as working chambers for a Carnot cycle.

24. A rotary piston machine, comprising:

a housing having a cylindrical housing inner wall and a longitudinal mid-axis;

at least one piston arranged in said housing, said at least one piston rotating about said longitudinal mid-axis when the rotary piston machine is operating and at the same time executing, via a control mechanism, a to-and fro linear movement parallel to said longitudinal mid-axis;

at least one chamber in said housing assigned to said at least one piston which periodically enlarges and reduces due to said to-and-fro linear movement of said at least one piston;

wherein said at least one piston has two end faces, and wherein said two end faces is assigned said at least one chamber and one further chamber which chambers enlarge and reduce mutually with respect to one another, wherein one chamber serves as working chamber for a Carnot cycle and the other chamber serves as boost-pressure chamber for generating boost-pressure in order to supply said working chamber with boost-pressure.

25. A rotary piston machine, comprising:

a housing having a cylindrical housing inner wall and a longitudinal mid-axis;

at least one piston arranged in said housing, said at least one piston rotating about said longitudinal mid-axis when the rotary piston machine is operating and at the same time executing, via a control mechanism, a to-and fro linear movement parallel to said longitudinal mid-axis;

at least one chamber in said housing assigned to said at least one piston which periodically enlarges and reduces due to said to-and-fro linear movement of said at least one piston;

wherein said at least one piston has two end faces, and wherein said two end faces is assigned said at least one chamber and one further chamber which chambers enlarge and reduce mutually with respect to one another, wherein one chamber serves as working chamber for a Carnot cycle and the other chamber serves as boost-pressure chamber for generating boost-pressure in order to supply said working chamber with boost-pressure, and wherein said boost-pressure chamber is connected to said working chamber directly through said at least one piston.

26. A rotary piston machine, comprising:

a housing having a cylindrical housing inner wall and a longitudinal mid-axis;

at least one first piston arranged in said housing eccentrically with respect to said longitudinal mid-axis, said at least one first piston rotating about said longitudinal mid-axis and at the same time executing, via a control mechanism, a to-and-fro movement parallel to said longitudinal mid-axis;

at least one first chamber in said housing assigned to said at least one first piston which periodically enlarges and reduces due to said to-and-fro linear movement of said at least one piston;

at least one second piston arranged in said housing eccentrically with respect to said longitudinal mid-axis, said at least one second piston rotating about said longitudinal mid-axis and at the same time executing, via the control mechanism, a to-and-fro linear movement parallel to said longitudinal mid-axis;

at least one second chamber in said housing assigned to said at least one second piston which is located opposite said at least one first chamber;

a rotor for guiding said at least one first piston and said at least one second piston which rotates jointly with said at least one first and second pistons about said longitudinal mid-axis and which is axially immovable, said rotor having a middle portion lying on said longitudinal mid-axis of said housing and separating said at least one first chamber from said at least one second chamber, said at least one first piston and said at least one second piston being assigned on sides facing away from said first and said second chamber, respectively, a third and a fourth chamber, wherein said middle portion of said rotor allows said third and fourth chambers to communicate with one another.

27. The rotary piston machine of claim 26, wherein said at least one second piston is arranged in rectilinear prolongation of said at least one first piston.

28. The rotary piston machine of claim 26, wherein said at least one first chamber is formed by a space between mutually confronting end faces of said at least one first piston and said at least one second piston.

29. The rotary piston machine of claim 26, wherein said linear movement of said at least one second piston is directed opposite to said linear movement of said at least one first piston.

30. The rotary piston machine of claim 26, wherein said housing has arranged in it at least two further pistons so that said housing has arranged in it at least four pistons, of which in each case two pistons are arranged opposite one another at the same height axially with respect to said longitudinal mid-axis of said housing and each case two pistons are arranged in rectilinear prolongation of one another.

31. The rotary piston machine of claim 26, wherein said control mechanism comprises at least one guide member arranged on said at least one first piston and at least one control cam curve which is formed in said housing in a wall and along which said guide member runs.

32. The rotary piston machine of claim 26, wherein said first and said second chambers serve as working chambers for Carnot cycles.

33. The rotary piston machine of claim 32, wherein said third and said fourth chambers serve as boost-pressure chambers which are connected to said working chambers via a connecting line which is located on an outside of said housing.

34. The rotary piston machine of claim 33, wherein a valve is arranged in said connecting line.

35. The rotary piston machine of claim 32, wherein said third an fourth chambers serve as boost-pressure chambers which are connected to said working chambers directly through said at least one first piston and said at least one second piston.

36. The rotary piston machine of claim 35, wherein at least one valve is arranged in said at least one first and said at least one second piston.

* * * * *